US010195105B2

(12) United States Patent
Cambridge

(10) Patent No.: US 10,195,105 B2
(45) Date of Patent: Feb. 5, 2019

(54) CAP ASSEMBLY FOR MASTURBATION DEVICE

(71) Applicant: THIKA HOLDINGS LLC, St. Pete Beach, FL (US)

(72) Inventor: Vivien Johan Cambridge, Myrtle Beach, SC (US)

(73) Assignee: THIKA HOLDINGS LLC, St. Pete Beach, FL (US)

( * ) Notice: Subject to any disclaimer, the term of this patent is extended or adjusted under 35 U.S.C. 154(b) by 32 days.

(21) Appl. No.: 15/205,912

(22) Filed: Jul. 8, 2016

(65) Prior Publication Data

US 2017/0007496 A1 Jan. 12, 2017

Related U.S. Application Data

(60) Provisional application No. 62/191,063, filed on Jul. 10, 2015.

(51) Int. Cl.

| | |
|---|---|
| ***A61H 19/00*** | (2006.01) |
| ***A61H 15/00*** | (2006.01) |
| *A61H 7/00* | (2006.01) |

(52) U.S. Cl.

CPC ..... *A61H 19/32* (2013.01); *A61H 15/00* (2013.01); *A61H 7/002* (2013.01); *A61H 2015/005* (2013.01); *A61H 2015/0035* (2013.01); *A61H 2201/123* (2013.01); *A61H 2201/1207* (2013.01); *A61H 2201/1215* (2013.01); *A61H 2201/1246* (2013.01); *A61H 2201/1253* (2013.01); *A61H 2201/149* (2013.01); *A61H 2201/1436* (2013.01); *A61H 2201/1654* (2013.01); *A61H 2201/1676* (2013.01); *A61H 2201/5007* (2013.01)

(58) Field of Classification Search

CPC ..... A61H 19/44; A61H 23/02
USPC ..... 600/38–41
See application file for complete search history.

(56) References Cited

U.S. PATENT DOCUMENTS

| | | | | |
|---|---|---|---|---|
| 5,501,650 | A | 3/1996 | Gellert | |
| 5,669,869 | A | 9/1997 | Strom | |
| 6,902,525 | B1 | 6/2005 | Jewell | |
| 2009/0099413 | A1 | 4/2009 | Kobashikawa et al. | |
| 2013/0197302 | A1* | 8/2013 | Levy | A61H 23/02 600/38 |
| 2013/0253458 | A1 | 9/2013 | Wu | |
| 2014/0378759 | A1* | 12/2014 | Fang | A61H 9/0078 600/38 |
| 2015/0196454 | A1 | 7/2015 | Levy | |

FOREIGN PATENT DOCUMENTS

| | | | |
|---|---|---|---|
| EP | 3 011 942 | A1 | 4/2016 |

* cited by examiner

*Primary Examiner* — Samuel Gilbert
(74) *Attorney, Agent, or Firm* — Volpe and Koenig, P.C.

(57) ABSTRACT

A cap assembly for removable attachment to a non-mechanized masturbation device is provided. The cap assembly comprises at least one moveable extension member, and at least one actuator adapted to move the extension member. The actuator may include a motor. The actuator is adapted to move the extension member in one or more selected directions, such that the extension member can contact an elastomeric gel provided as part of the non-mechanized masturbation device, and move a portion of the elastomeric gel to impart sensation to a user.

14 Claims, 8 Drawing Sheets

CAP ASSEMBLY FOR MASTURBATION DEVICE

CROSS-REFERENCE TO RELATED APPLICATIONS

This application claims the benefit of U.S. provisional patent application 62/191,063, filed on Jul. 10, 2015, the entire contents of which is incorporated by reference as if fully set forth herein.

FIELD OF THE INVENTION

The present invention relates to a cap assembly containing a mechanized unit for use with a non-mechanized masturbation devices that include a shell and having an elastomeric gel insert for pleasuring a user. More specifically, the present invention presents a cap assembly for use with a non-mechanized masturbation device having a shell and an elastomeric gel insert, which cap includes assemblies for imparting movement to the elastomeric gel, and which cap assembly can easily and quickly convert a non-mechanized masturbation device to a mechanized masturbation device.

BACKGROUND

Male masturbation devices exist that comprise a body portion consisting of what may be a hard outer shell. The shell may be a cylindrical or tubular shell similar in shape to the handle of a flashlight, and may have one open end, or two open ends. At an end portion of these devices, and extending at least partially within the interior, is an elastomeric gel that resembles human flesh and is molded to resemble various human body parts and/or orifices. The gel is inserted into a shell which serves to allow easier grasping of the contraption, such as a grip or handle, and which may help conceal the molded gel material. The shell usually includes at least one opening for access to the gel and at least one cap to close the opening when it is not in use. Some known devices include one opening on a side opposite to the molded orifice that will be penetrated. This rear opening is used for exhaust of air and for cleaning. The devices then also include a cap for the rear opening to conceal the gel and generally to close ad secure the device. The rear cap usually comprises screw threading to allow quick attachment and detachment to the shelled masturbating device. Some devices of the current art are mechanized where motors cause the gel insert to move within the hard shell but such devices are more expensive and complicated as they comprise a motor and power elements. In addition, the mechanical parts of such known units cannot be removed or transferred to a non-mechanized device. Moreover, many users already have a non-mechanized device. There are many non-mechanized devices that have been produced and were purchased for low cost and simplicity. There is no way to quickly and easily convert a non-mechanized device to a mechanized device if the desire or need arises.

Masturbation devices of the relevant art are generally non-mechanized or manually operated devices (e.g., movement is provided by a user's hand), comprising an elastomeric gel that is often enclosed in a hard shell for grip and comfort and sometimes for concealment. The elastomeric gel material is usually molded to resemble a human orifice and it contains an opening, tunnel or channel for accommodating a male sex organ. These devices often include one or more caps that attach to the hard outer shell for access to the gel material. The current art also includes devices that are mechanized where the polymer gel inside the hard shell is caused to move. The polymer gel moves a significant distance along the long axis (length) of what is generally a tubular outer shell. If a male user inserts his penis into the opening in the gel and the gel moves relative to the user's penis, then this configuration causes a sensation of a penis inserted into or grasped by a sexual partner and stroking within the orifice or hand in which it is inserted.

There is currently no device that quickly and easily allows a user to convert a non-mechanized (e.g., manually operated) masturbation device, such as those described, to a mechanized device, and back to a manual device. It is also true that mechanized devices of the relevant art cannot detect the actions of the male user and modulate that action into data for use in computer applications.

SUMMARY OF THE INVENTION

The present invention presents a modified, mechanized cap assembly which is configured to attach to and detach from the shell of a non-mechanized masturbation device and which cap comprises one or more movable prongs for inserting around the elastomeric gel inserted into a shell, which prongs move along the long axis (length) of the shell when the cap is attached to the shell, and may also move radially across the width of the shell. The prongs are shaped so that they can be felt by the user of the device through the gel material or so that they move the gel material as the prongs move.

In an aspect of the invention, the cap assembly comprises at least one moveable extension member, and at least one actuator adapted to move the extension member. The actuator may include a motor. The actuator may be adapted to move the extension member in one or more selected directions, such that the extension member can contact an elastomeric gel provided as part of the non-mechanized masturbation device, and move a portion of the elastomeric gel.

A cap assembly for removable attachment to a non-mechanized masturbation device according to an aspect of the present invention includes one or more prongs. The prongs extend along a length of an attached non-mechanized masturbation device and are moveable. The prongs are positioned adjacent a surface of elastomeric gel provided as part of the non-mechanized masturbation device. A longitudinal actuator is provided for moving the prongs along a longitudinal axis (e.g., lengthwise) of the non-mechanized masturbation device. A radial actuator is provided for moving the prongs radially (e.g., transversely or across the width of the generally cylindrical shell having a generally circular cross-section) of the non-mechanized masturbation device. Movement of the prongs imparts sensations to a user who has inserted a body part into an orifice of the non-mechanized masturbation device. The cap assembly according to the present invention provides both a lengthwise rubbing movement and sensation, and a constricting and releasing movement and sensation.

DESCRIPTION OF THE DRAWINGS

A more detailed understanding may be had from the following description, given by way of example in conjunction with the accompanying drawings wherein.

DETAILED DESCRIPTION

Figure 8:
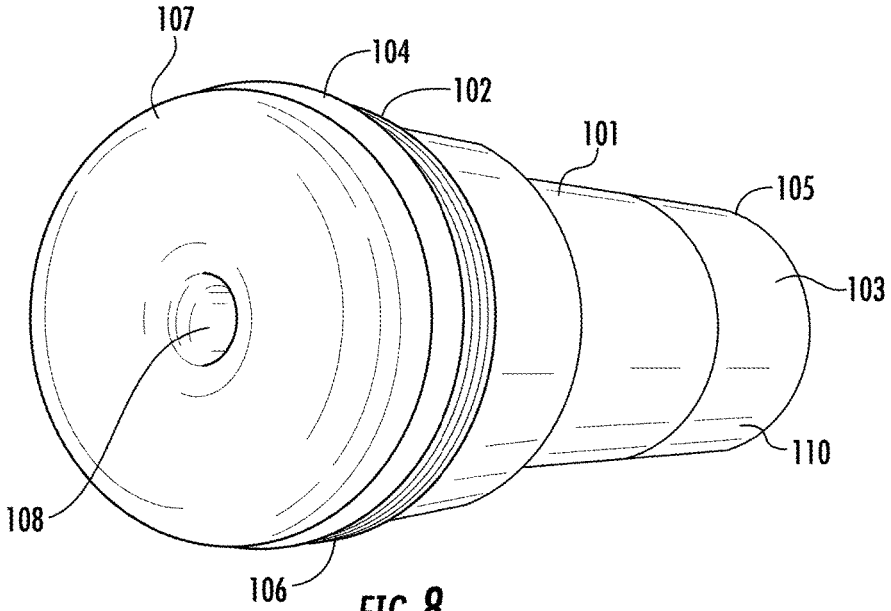
FIG. 8 shows a non-mechanized masturbation device that may be used with the cap assembly 1 of the present invention.

As shown in FIG. 8, a non-mechanized masturbation device 100 is shown, comprising a body formed as a shell 101, and having a first insertion portion 102 formed as an opening 106 at a first end 104 of the non-mechanized masturbation device 100, and a cap portion 103 at a second end 105. The shell 101 is generally cylindrical and has a generally circular cross-section. The first insertion portion 102 comprises an opening 106. An elastomeric gel 107 having an opening 108 that may be shaped to resemble a human anatomy portion, for example, a mouth, vaginal or anal opening, is inserted into the first insertion portion 102. The elastomeric gel 107 generally has an external portion that extends from the first insertion portion, and an internal portion that extends into the interior 111 of the shell. The elastomeric gel 107 may comprise any suitable pliable material, such as, for example, rubber, latex, silicone, or a mixture of plasticizing oil and a block copolymer selected from styrene ethylene butylene styrene block copolymers and styrene ethylene propylene styrene block copolymers, or combinations of any of the foregoing. U.S. Pat. Nos. 5,782,818 and 5,807,360, the entire contents of both of which are incorporated by reference as if fully set forth herein, disclose suitable arrangements for a non-mechanized masturbation device 100, as well as suitable elastomeric gel 107 materials. The second end 105 of the non-mechanized masturbation device 100 is preferably threaded, and includes a cap 110 threadedly attached to the second end 105. The cap 110 can be removed to expose an interior 111 of the shell 101. The non-mechanized masturbation device 100 does not include any motors or power source for moving the elastomeric gel 107. Movement must be provided by a user holding such a device.

An example of such a non-mechanized masturbation device 100 such as the one described herein is the FLESHLIGHT™. The present invention is directed to a cap assembly 1 that is configured to attach to an existing non-mechanized masturbation device 100 such as the FLESHLIGHT™ in order to impart motion to the elastomeric gel 107. The cap assembly 1 comprises a body 2 having an interior housing various components of the cap assembly 1.

The cap assembly 1 has a body 2 including a first end 7 and an attachment end 8 for removable engagement to the second end 105 of a non-mechanized masturbation device 100. The cap assembly 1 may be removably engaged to the send end 105 of the non-mechanized masturbation device 100 such as by a threaded engagement, a snap fit, a frictional fit, a bayonet connection, or any other acceptable engagement whereby the cap assembly 1 can be attached to the send end 105 of the non-mechanized masturbation device 100.

As shown in FIGS. 2-3 and 5-6, the cap assembly 1 preferably comprises a longitudinal actuator assembly 5 for imparting longitudinal movement (e.g., movement along the length of the shell) to one or more prongs 9, and/or a radial actuator assembly 6 for imparting radial movement to one or more prongs 9. The prongs 9 are configured to move under at least partial control of a first motor and/or a second motor. Each prong 9 is an extension member that extends away from the cap assembly 1 and into the interior of the shell 101 adjacent to the elastomeric gel 107. The prongs 9 may be, for example, plastic or metal rods that may have any cross-sectional shape, such as, for example, round, rectangular, or oblong. The cross-sectional shape of the prongs 9 may be varied at different portions along the lengths of the prongs 9.

Figure 1:
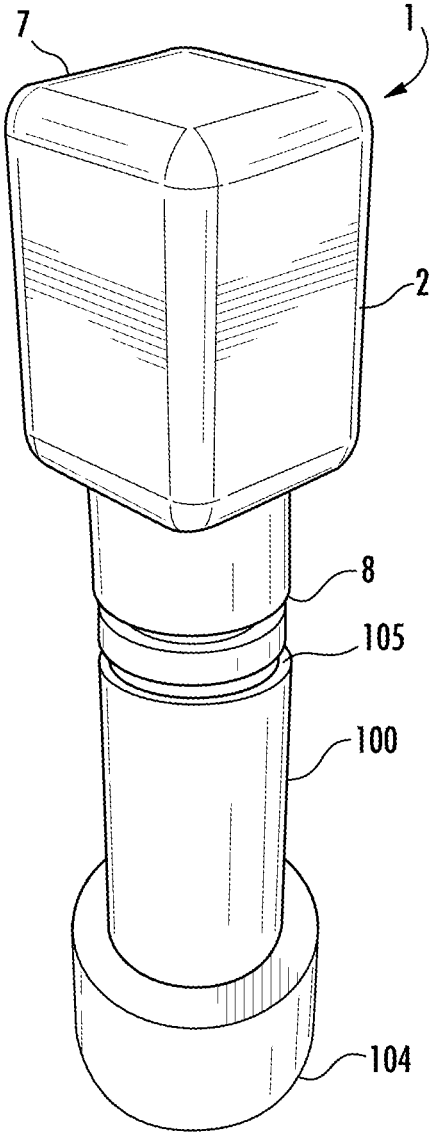
FIG. 1 shows a perspective view of a portion of a non-mechanized masturbation device with a cap assembly according to the present invention attached to the non-mechanized masturbation device.
Figure 2:
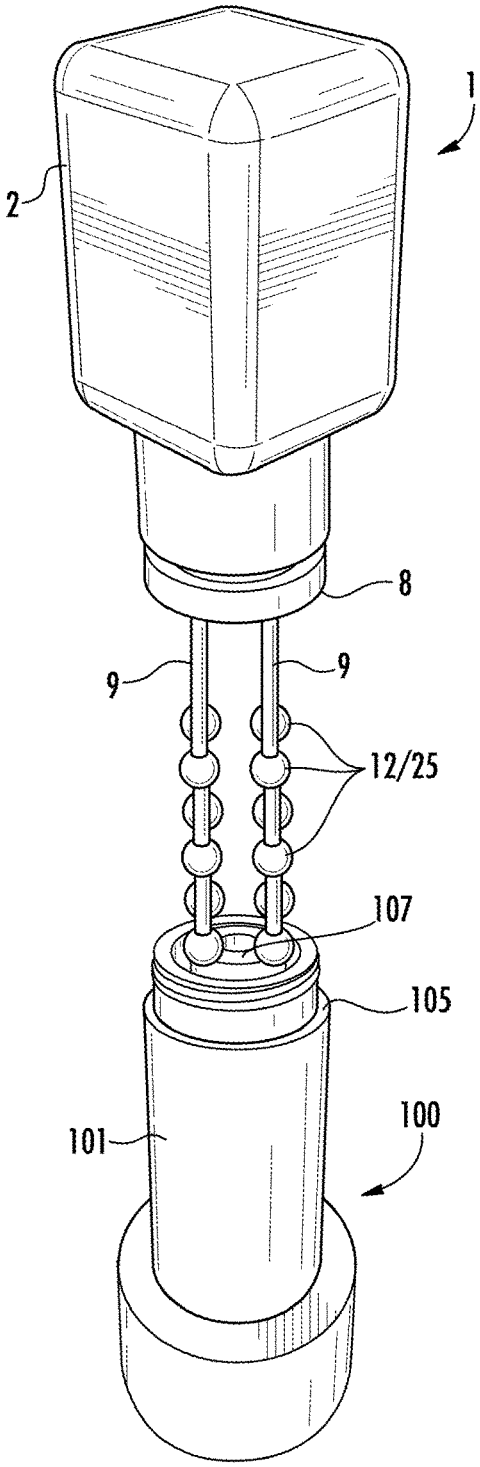
FIG. 2 shows a perspective view of a portion of a non-mechanized masturbation device with a cap assembly according separated from the non-mechanized masturbation device.
Figure 3:
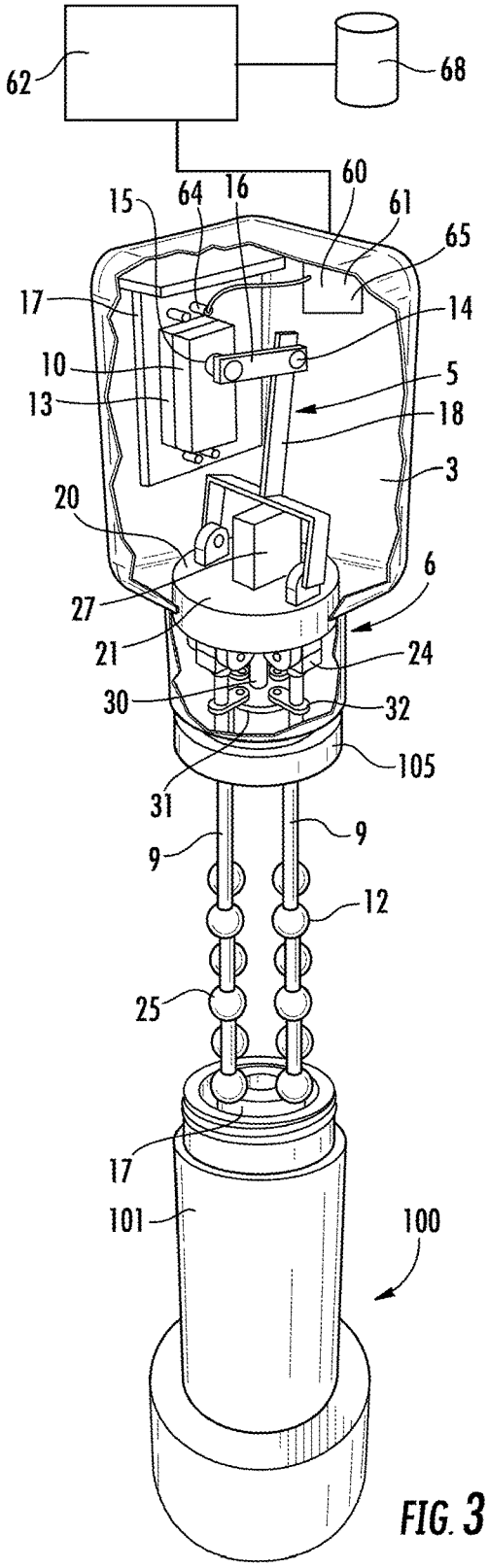
FIG. 3 shows a perspective view of a portion of a non-mechanized masturbation device with a cap assembly according to the present invention ready for attachment to the non-mechanized masturbation device, with a portion of the cap assembly in partial transparency to show the interior of the cap assembly.

As shown in FIG. 2, preferably, the prongs 9 have one or more sensation imparting elements 12, which can be, for example, bumps, protrusions or beads 25 positioned along the prongs 9. As will be described in greater detail below, the prongs 9 and sensation imparting elements will move in order to impart movement to the elastomeric gel 107, and thereby to provide pleasurable sensation to a user of the non-mechanized masturbation device.

Figure 5:
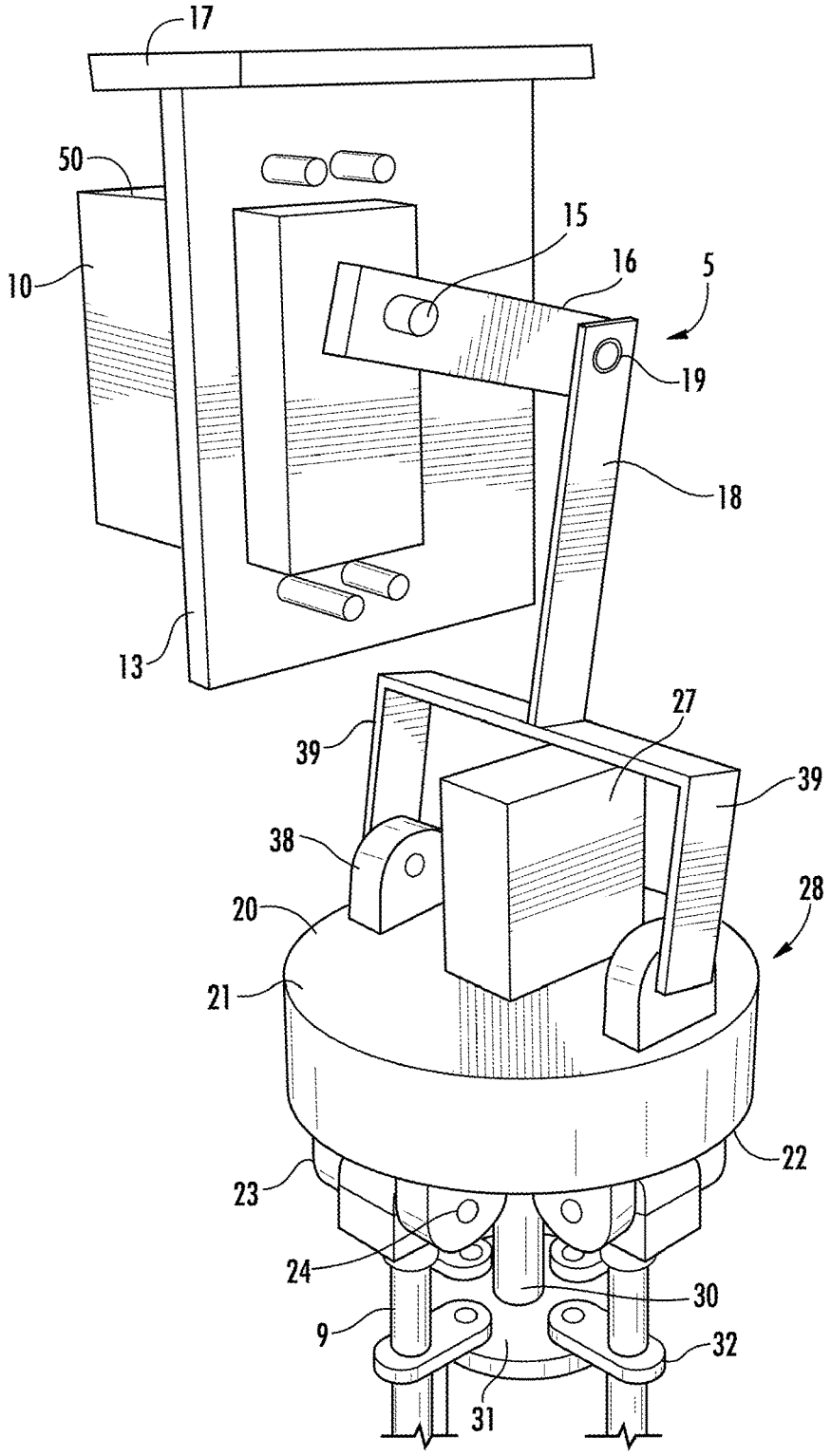
FIG. 5 shows a perspective view of an embodiment of the longitudinal actuator assembly and the radial actuator assembly of the invention.

As shown in greater detail in FIG. 5, the longitudinal actuator assembly 5 preferably comprises a first drive mechanism 13. The first drive mechanism 13 preferably comprises a first motor 10 positioned in the interior 3 of the cap assembly 1 and may be affixed to a wall of the interior 3 of the cap assembly 1, or to an assembly frame 17 positioned in the interior of the cap assembly 1. The first motor 10 is operatively connected to a crank arm 16 that is moved by the first motor 10. The first motor 10 may include a drive shaft 15, and the crank arm 16 may be movably connected to the drive shaft 15, preferably whereby the movement of the drive shaft 15 in turn moves the crank arm 16. For example, movement, such as by rotation, of the drive shaft 15 by the first motor 10 operates the crank arm 16. The crank arm 16 is further movably coupled to a drive assembly 18. The crank arm 16 preferably attaches to the drive assembly 18 with an off-center connection. The crank arm 16 and drive assembly 18 are preferably connected at a first end of the drive assembly 18 by a hinged connection 19. The drive assembly 18 may be formed as an extension member branching off into two arms 39, as shown in FIG. 5, the drive assembly 18 is further hingedly coupled to a piston 20. Operation of the first motor 10 rotates the drive shaft 15, which in turn turns the crank arm 16. The crank arm 16 operates the drive assembly 18, whereby the drive assembly 18 pushes the piston 20 from a first position to a second position.

The piston 20 has an upper face 21 and a lower face 22, with drive assembly attachment portions 38 extending from the upper face 21, and prong attachment portions 23 extending from the lower face 22. The prongs 9 are each connected, such as by a hinge 24, to the prong attachment portions 23 of the lower face 22 of the piston 20. Movement of the piston 20 from a first position to a second position causes the prongs 9 to move inside the shell 101 of non-mechanized masturbation device 100 in a longitudinal direction, reciprocating back and forth along the length (longitudinal axis) of the shell 101. To the extent at least a portion of the prongs 9 contacts the outer surface 109 of the elastomeric gel 107, movement of the prongs 9 will in turn move portions of the elastomeric gel 107.

The cap assembly 1 of an embodiment of the present invention preferably further includes radial actuator assembly 6 which operated as a constriction mechanism to impart radial movement to the prongs 9. The radial actuator assembly 6 comprises a "twist-and-bend" mechanism, explained in further detail below, which causes the prongs 9 to move generally radially (e.g., traverse to the longitudinal axis, or across the width of the shell) of shell 101 in such a way that in a first position the prongs 9 are positioned to constrict the elastomeric gel 107, and in a second position the prongs 9 release the elastomeric gel 107 to expand to its original shape or position. This constricting and releasing action may be felt by user of the non-mechanized masturbation device 100 whose body part is inserted into the opening of elastomeric gel 107.

The radial actuator assembly 6 includes a second motor 27 including a second drive shaft 29. The second motor 27 may be coupled to or mounted on the piston 20, or otherwise positioned as part of the cap assembly 1 within the interior 3 of the cap assembly 1 so as not to interfere with other components.

The second motor 27 is coupled to a second drive mechanism 28. The second drive mechanism 28 preferably comprises a rotating rod 30 that is coupled to the second drive shaft 29 of second motor 27 such that movement of the second drive shaft operated the rotating rod 30. The second drive shaft 29 may comprise the rotating rod 30. The rotating rod 30 is aligned between the prongs 9, and is generally positioned within inner portions of the prongs 9, such as centrally in between the prongs 9. The end of the rod preferably includes a spacer element 31 that may be formed as a circular disc having a diameter larger than the diameter of the other portion of the rotating rod 30.

Figure 4:
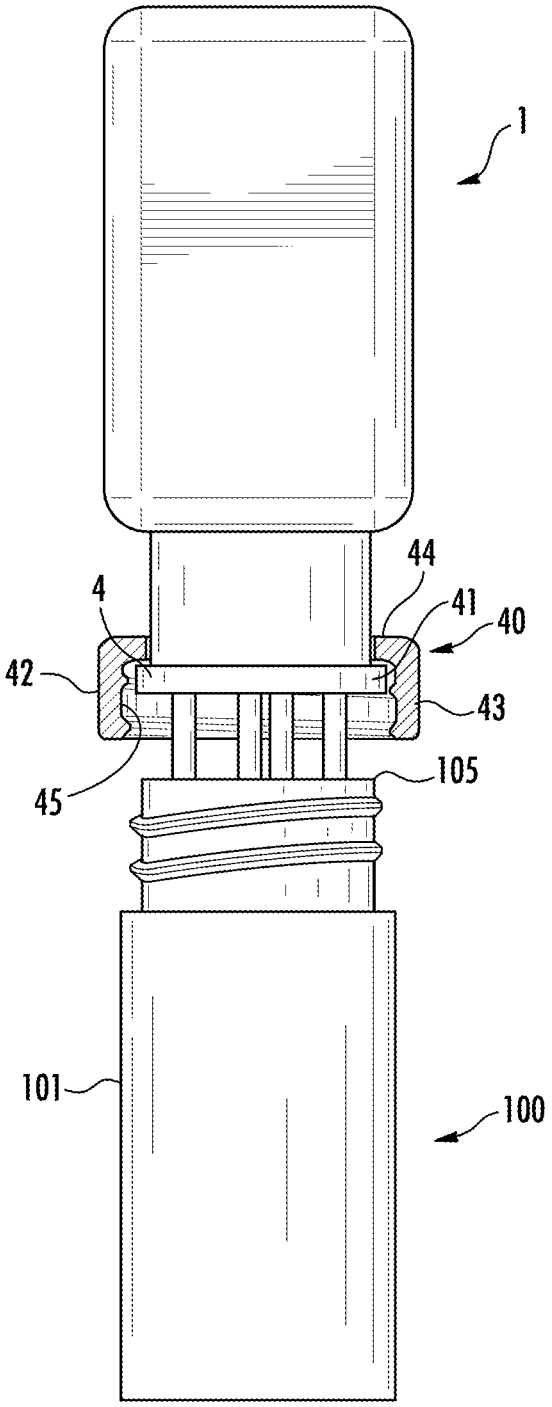
FIG. 4 shows a side view of a non-mechanized masturbation device with a cap assembly 1 according to the present invention, with the cap assembly partially separated from the non-mechanized masturbation device, and showing the tightening collar in cross-section.
Figure 6:
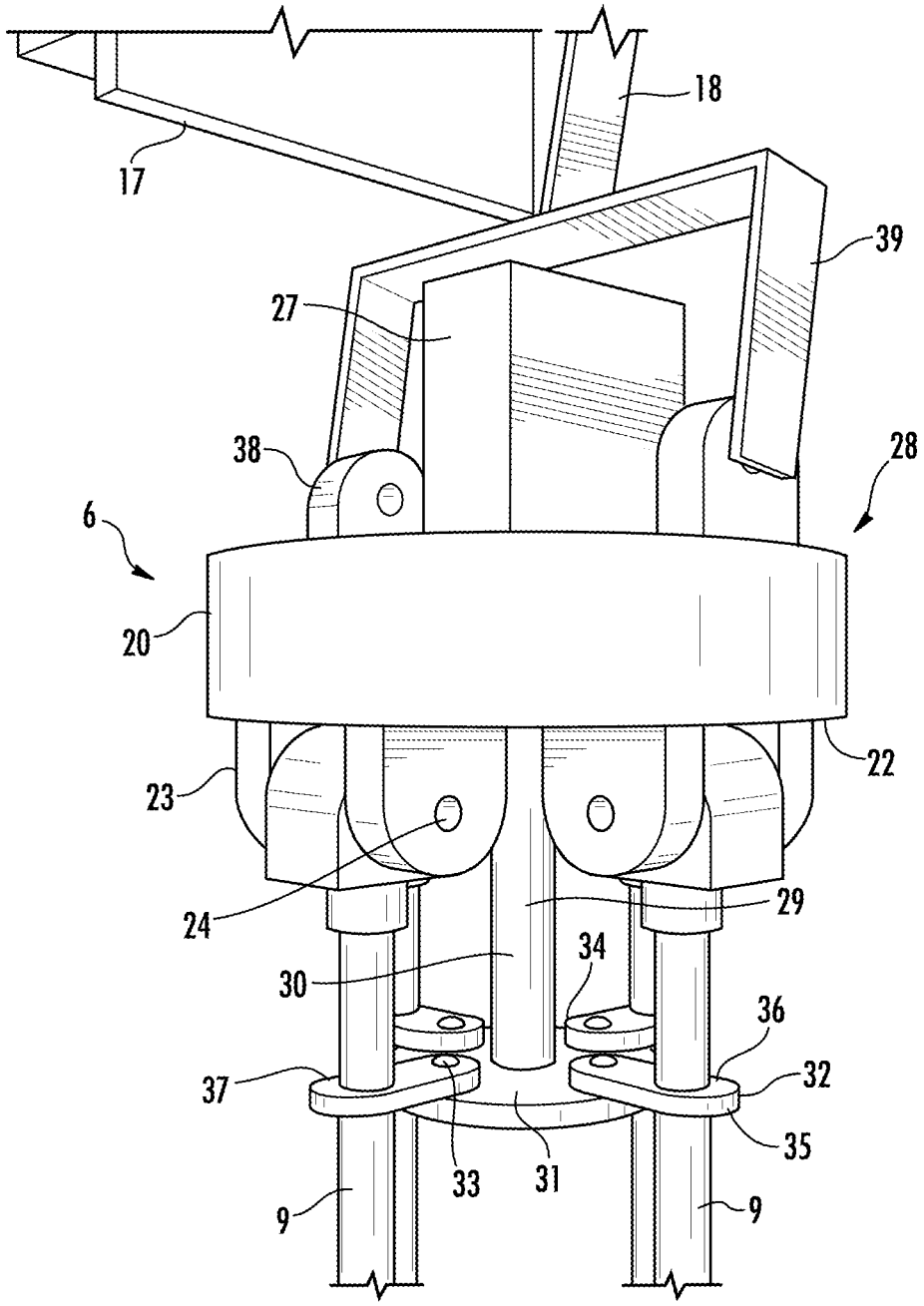
FIG. 6 shows another perspective view of an embodiment of the longitudinal actuator assembly and the radial actuator assembly of the invention.
Figure 7:
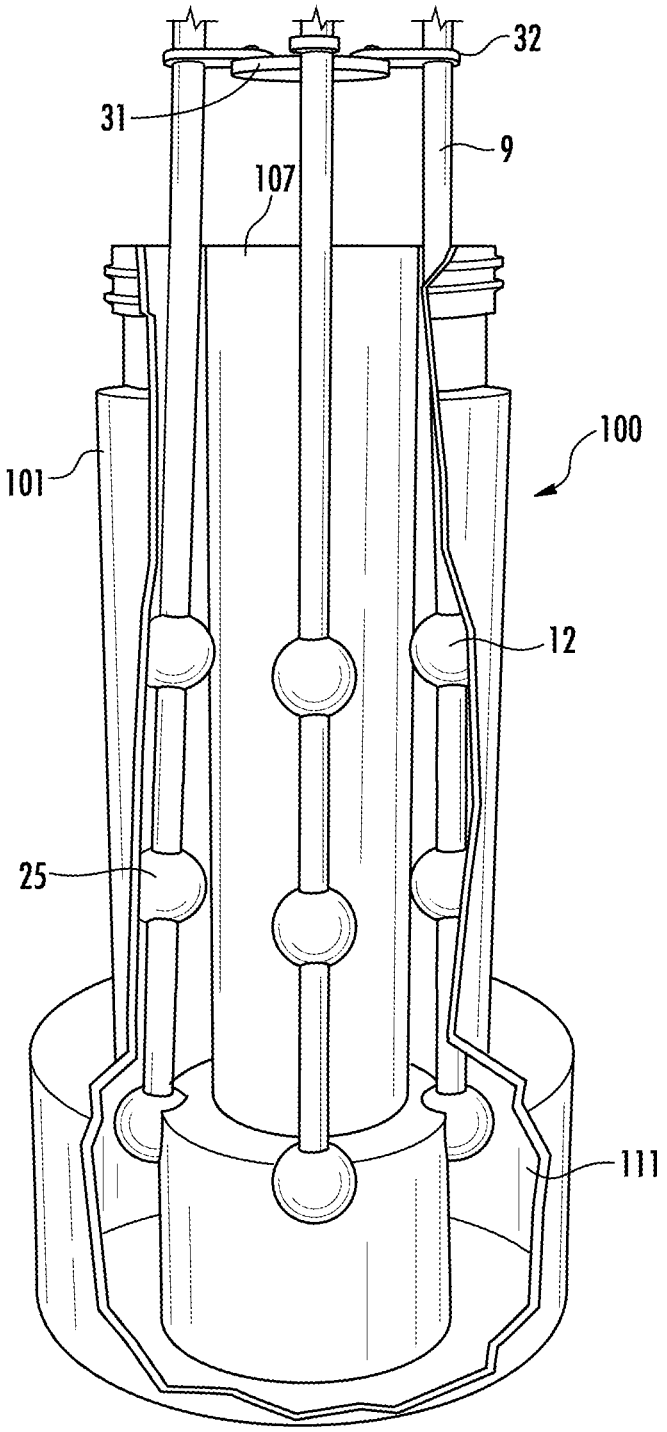
FIG. 7 shows a portion of a non-mechanized masturbation device including an elastomeric gel in partial transparency, showing the prongs of the cap assembly 1 of the present invention positioned adjacent the elastomeric gel.

One or more extension arms 32 are configured to pivotally attach each of the prongs 9 to the spacer element 31. The extension arms 32 are pivotally coupled to the spacer element 31 by hinges 33 at first ends 34 as shown in FIG. 6. The extension arms 32 are further coupled to the prongs 9 at second ends 35 of the extension arms 32. The second ends of the extension arms 32 may be coupled to the prongs 9 in a pivotable fashion. For example, the second ends of the extension arms 32 may have openings 36 through which the prongs 9 are positioned, as shown in FIG. 4. The prongs 9 are movable within the openings, and the extension arms 32 can thereby move relative to the prongs 9 and pivot relative to the prongs 9.

The spacer element 31 provides some distance between the narrower rotating rod 30 portion and the first ends of the extension arms 32. The extension arms 32 provide some distance between the spacer element 31 and the second ends of the extension arms 32 that are coupled to the prongs 9. Each of the extension arms 32 preferably attaches to a separate prong 9.

The extension arms 32 couple to the spacer element 31 through hinges 33 and to the prongs 9 through pivotable connections 37 allowing extension arms 32 to move with respect to both spacer element 31 and prongs 9, and so that the rotational movement of the rotating rod 30 caused by second motor 27 causes extension arms 32 to twist. The rotating rod 30 moves both clockwise and counter-clockwise (as viewed from above), in order to twist the extension arms 32 in multiple positions. This twisting motion in turn pulls the prongs 9 in a direction that is generally inward and radial to the rotating rod 30 and hence generally radial to the shell 101, causing constricting action of the elastomeric gel 107 positioned and squeezed between the prongs 9. Rotation of rotating rod 30 back towards its original (starting) position causes prongs 9 to move generally outwardly and radial to rod causing releasing action to elastomeric gel 107, such as to its original position.

In operation, the prongs 9 protrude into the interior of the shell 101 when the cap assembly 1 is attached to the shell 101, and are positioned adjacent to a surface of the elastomeric gel 107. As discussed, the cap assembly 1 may be attached to the shell 101 such as, for illustration purposes, through a threaded or snapping engagement, latched engagement, or a frictional fit. Any manner for releasably attaching the cap assembly 1 to the shell 101 is acceptable.

The longitudinal actuator assembly 5 causes prongs 9 to move generally in a reciprocating fashion along the long axis (longitudinally) of the non-mechanized masturbation device 100 as driven by the first drive mechanism 13. The prongs 9 are in contact with at least a surface of the elastomeric gel 107 positioned in the interior of the shell 101, such that movement of the prongs 9 causes the elastomeric gel 107 to move in response to the movement of the prongs 9. This movement causes physical sensations to be felt by a user of non-mechanized masturbation device 100 whose penis is inserted into orifice of elastomeric gel 107. The prong 9 protrusions may provide added sensations as they move along the elastomeric gel 107.

The radial actuator assembly 6 causes prongs 9 to move generally in a reciprocating fashion along the transverse axis (radially, along the width) of the non-mechanized masturbation device 100 as driven by the second drive mechanism 28. The prongs 9 are in contact with at least a surface 109 of the elastomeric gel 107 positioned in the interior of the shell 101, such that movement of the prongs 9 causes the elastomeric gel 107 to constrict and release. This movement causes physical sensations to be felt by a user of non-mechanized masturbation device 100 whose penis is inserted into orifice of elastomeric gel 107. The prong 9 protrusions may provide added sensations as they move against the elastomeric gel 107.

FIG. 4 shows the device of the present invention positioned for attached to the second end 105 of the shell 101 of a non-mechanized masturbation device 100. The cap assembly 1 may be attached to the shell 101 such as by a threaded collet or collar 40 arrangement. As shown in FIG. 4, cap assembly 1 can include a flanged attachment end 4 comprising at least one outwardly extending flange 41, surrounded by a tightening collar 40 formed as a ring 42. The ring 42 may be freely rotatable about the outer surface of the body 2 of the cap assembly 1. The ring 42 may include a cylindrical portion 43 and inwardly facing flap 44, which flap 44 contacts flange 41 on the cap assembly 1 to prevent the ring 42 from separating from the cap assembly 1. The ring 42 includes inner threads 45 which threads are configured to couple with the outer threads on the second end 105 of the shell 101 so that user can quickly and easily attach and detach cap assembly 1 to and from shell 101 of the non-mechanized masturbation device 100.

The cap assembly 1 further comprises one or more power sources, such as one or more batteries 50, to provide power to the motors.

The cap assembly 1 may further comprise a controller 60 in communication with the first and second motor, which may be provided as a circuit board 61. The circuit board 61 interfaces with or otherwise includes a processor 62, such as a microprocessor. The controller 60 causes first motor 10 and second motor 27 to move under control of software stored in storage means 63, such as a computer readable medium or computer memory. A sensor 64 and a transmitter 65 arrangement may be provided to detect and transmit information regarding the movement of the cap assembly 1 to the controller to control the operation of the motors, according to the directions of the software.

The present invention provides for both longitudinal movement and sensation, and constricting movement and sensation. The present invention can be readily installed in a masturbation shell 101 of a non-mechanized masturbation device 100, providing for mechanical movement of the elastomeric gel 107.

It is appreciated that the extension members may be directly in contact with one or more actuators, or the extension members may be indirectly in contact with one or more actuators. The prongs may extend from a portion of the cap, and the cap may comprise one or more actuators that have extensions or moveable parts that can contact and move the prongs in selected directions.

The present invention provides a significant advance in that the cap assembly of the present invention is an independent and complete unit containing all necessary components for imparting movement to the elastomeric gel of a non-mechanized masturbation device, and completely separable from a non-mechanized masturbation device. This provides a convenient and cost-effective way to increase the pleasure provided by existing or developed non-mechanized masturbation devices. A user may have multiple non-mechanized masturbation devices, and could use a single cap assembly with any of these.

It will be appreciated that the foregoing is presented by way of illustration only and not by way of any limitation. It is contemplated that various alternatives and modifications may be made to the described embodiments without departing from the spirit and scope of the invention. Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A cap assembly for removable attachment to a non-mechanized masturbation device that includes an elastomeric gel sleeve, the cap assembly comprising:

at least one extension member adapted to be inserted into a first end of the non-mechanized masturbation device and extend along a length of an interior of the non-mechanized masturbation device, the extension member surrounding a radially outer surface of the elastomeric gel sleeve; and, at least one actuator adapted to move the extension member, wherein movement of the extension member moves at least a portion of the elastomeric gel sleeve, and the actuator includes a longitudinal actuator to axially displace the extension member relative to the elastomeric gel sleeve and the first end of the non-mechanized masturbation device.

2. The cap assembly of claim 1, wherein the actuator further includes a radial actuator.

3. The cap assembly of claim 1, wherein the longitudinal actuator is adapted to move the extension member in a reciprocating manner from a first position to a second position along a length of the non-mechanized masturbation device.

4. The cap assembly of claim 3, wherein the longitudinal actuator comprises a drive mechanism.

5. The cap assembly of claim 4, wherein the drive mechanism comprises a first motor, a crank-arm movably coupled to the motor, a drive assembly, and a piston, and wherein the piston is coupled to a first end of the extension member.

6. The cap assembly of claim 5, wherein the drive mechanism is positioned axially outside of the non-mechanized masturbation device and the elastomeric gel sleeve.

7. The cap assembly of claim 1, wherein the extension member is connected to a pivotable extension arm.

8. The cap assembly of claim 1, wherein the extension member comprises a moveable prong.

9. The cap assembly of claim 1, where the cap assembly comprises a threaded collar for attachment to a threaded end of the non-mechanized masturbation device.

10. The cap assembly of claim 1, further comprising multiple extension members, and each of the multiple extension members are commonly linked via a drive mechanism.

11. The cap assembly of claim 10, further comprising multiple prongs.

12. The cap assembly of claim 1, wherein the actuator comprises a radial actuator adapted to move the extension member in a radial manner across a width of the non-mechanized masturbation device.

13. The cap assembly of claim 12, wherein the radial actuator comprises a drive mechanism.

14. The cap assembly of claim 13, wherein the drive mechanism comprises a motor, a crank-arm movably coupled to the motor, a drive assembly, and a piston, and wherein the piston is coupled to a first end of the extension member.

* * * * *